US009196970B2

(12) United States Patent
Piazza et al.

(10) Patent No.: US 9,196,970 B2
(45) Date of Patent: Nov. 24, 2015

(54) METAMATERIAL RECONFIGURABLE ANTENNAS

(71) Applicants: Adant Technologies, Inc., Pleasanton, CA (US); Drexel University, Philadelphia, PA (US)

(72) Inventors: Daniele Piazza, Lodi (IT); Michele D'Amico, Milan (IT); Kapil R. Dandekar, Philadelphia, PA (US)

(73) Assignees: Adant Technologies, Inc., Pleasanton, CA (US); Drexel University, Philadelphia, PA (US)

( * ) Notice: Subject to any disclaimer, the term of this patent is extended or adjusted under 35 U.S.C. 154(b) by 0 days.

(21) Appl. No.: 14/449,854

(22) Filed: Aug. 1, 2014

(65) Prior Publication Data

US 2015/0022407 A1 Jan. 22, 2015

Related U.S. Application Data

(63) Continuation of application No. 13/516,229, filed as application No. PCT/EP2010/007653 on Dec. 16, 2010, now abandoned.

(60) Provisional application No. 61/286,786, filed on Dec. 16, 2009.

(51) Int. Cl.
*H01Q 9/00* (2006.01)
*H01Q 23/00* (2006.01)
(Continued)

(52) U.S. Cl.
CPC ..... *H01Q 23/00* (2013.01); *H01Q 1/2216* (2013.01); *H01Q 3/00* (2013.01); *H01Q 3/01* (2013.01); *H01Q 11/02* (2013.01); *H01Q 13/28* (2013.01); *H01Q 15/0006* (2013.01)

(58) Field of Classification Search
CPC ..... H01Q 11/02; H01Q 23/00; H01Q 3/00
USPC ..... 343/700 MS, 745, 749, 750, 753
See application file for complete search history.

(56) References Cited

U.S. PATENT DOCUMENTS 5,440,320 A 8/1995 Lach et al.
6,633,260 B2 10/2003 Paschen et al.
(Continued)

FOREIGN PATENT DOCUMENTS

DE 20 2006-017474 3/2007
DE 10 2006-053987 3/2008
(Continued)

OTHER PUBLICATIONS

Caloz et al., "A novel composite right-/left-handed coupled-line directional coupler with arbitrary coupling level and broad bandwidth", IEEE Transactions on Microwave Theory and Techniques, 2004, vol. 52, No. 3, 980-992.
(Continued)

*Primary Examiner* — Tho G Phan
(74) *Attorney, Agent, or Firm* — Baker & Hostetler LLP

(57) ABSTRACT

Leaky wave antennas that can be reconfigured in pattern and/or polarization by exploiting the characteristic of metamaterial structures loaded with variable capacitor and inductors employ a Composite Right Left Handed (CRLH) unit cell with two independent DC biases used to actively change the group delay of the transmission line and the polarization of the radiated field while preserving good impedance matching. Different degrees of pattern and polarization reconfigurability are achieved by cascading multiple of these unit cells along a straight line, a circular line or a zigzag line while preserving high gain for all the antenna configurations and good impedance matching.

19 Claims, 16 Drawing Sheets

(51) Int. Cl.

| | |
|---|---|
| ***H01Q 3/00*** | (2006.01) |
| ***H01Q 13/28*** | (2006.01) |
| ***H01Q 15/00*** | (2006.01) |
| ***H01Q 1/22*** | (2006.01) |
| ***H01Q 3/01*** | (2006.01) |
| ***H01Q 11/02*** | (2006.01) |

(56) References Cited

U.S. PATENT DOCUMENTS

| | | | | |
|---|---|---|---|---|
| 6,958,729 | B1 * | 10/2005 | Metz | 343/700 MS |
| 7,205,941 | B2 * | 4/2007 | Wang et al. | 343/700 MS |
| 7,253,780 | B2 * | 8/2007 | Sievenpiper | 343/745 |
| 7,319,398 | B2 | 1/2008 | Marino | |
| 7,420,518 | B2 | 9/2008 | Boisbouvier et al. | |
| 7,453,363 | B2 | 11/2008 | Reynolds | |
| 7,469,152 | B2 | 12/2008 | Cetiner et al. | |
| 7,496,329 | B2 | 2/2009 | Patel et al. | |
| 7,576,627 | B2 | 8/2009 | Shastry et al. | |
| 7,580,684 | B2 | 8/2009 | Cyr et al. | |
| 7,592,961 | B2 | 9/2009 | Thober et al. | |
| 7,620,424 | B2 | 11/2009 | Cetiner et al. | |
| 7,724,141 | B2 | 5/2010 | Reynolds | |
| 7,764,232 | B2 * | 7/2010 | Achour et al. | 343/700 MS |
| 8,451,183 | B2 * | 5/2013 | Penev et al. | 343/745 |
| 8,462,063 | B2 * | 6/2013 | Gummalla et al. | 343/745 |
| 2002/0044096 | A1 | 4/2002 | Chung | |
| 2004/0266481 | A1 | 12/2004 | Patel et al. | |
| 2005/0200528 | A1 | 9/2005 | Carrender et al. | |
| 2006/0125638 | A1 | 6/2006 | Marino | |
| 2006/0222101 | A1 | 10/2006 | Cetiner et al. | |
| 2007/0040687 | A1 | 2/2007 | Reynolds | |
| 2007/0040689 | A1 | 2/2007 | Reynolds | |
| 2007/0141997 | A1 | 6/2007 | Wulff et al. | |
| 2007/0194929 | A1 | 8/2007 | Wagner et al. | |
| 2008/0072082 | A1 | 3/2008 | Lertora et al. | |
| 2008/0110255 | A1 | 5/2008 | Lertora et al. | |
| 2009/0081965 | A1 | 3/2009 | Erceg et al. | |
| 2009/0146816 | A1 | 6/2009 | Patel et al. | |
| 2009/0209212 | A1 | 8/2009 | Cetiner et al. | |
| 2010/0060449 | A1 | 3/2010 | Lertora et al. | |
| 2011/0032079 | A1 | 2/2011 | Bloy et al. | |

FOREIGN PATENT DOCUMENTS

| | | | |
|---|---|---|---|
| EP | 1610258 | | 12/2005 |
| EP | 1758256 | | 2/2007 |
| EP | 1681582 | | 8/2008 |
| EP | 2202891 | | 6/2010 |
| EP | 2230721 | | 9/2010 |
| FR | 2879355 | A1 | 6/2006 |
| WO | WO 96/31787 | | 10/1996 |
| WO | WO 03/092172 | | 11/2003 |
| WO | WO 2005/043292 | | 5/2005 |
| WO | WO 2006/099552 | | 9/2006 |
| WO | WO 2007/024347 | | 3/2007 |
| WO | WO 2007/024348 | | 3/2007 |
| WO | WO 2007/048052 | | 4/2007 |
| WO | WO 2009/018156 | | 2/2009 |
| WO | WO 2009/086252 | | 7/2009 |
| WO | WO 2010/057263 | | 5/2010 |
| WO | WO 2011/024575 | | 3/2011 |
| WO | WO 2011/072844 | A1 | 6/2011 |
| WO | WO 2011/072845 | A3 | 6/2011 |

OTHER PUBLICATIONS

Caloz et al., "Composite right/left-handed transmission line metamaterials", IEEE Microwave Magazine, Sep. 1, 2004, vol. 5, No. 3, 34-50.

Caloz et al., "Metamaterial-Based Electronically Controlled Transmission-Line Structure as a Novel Leaky-Wave Antenna With Tunable Radiation Angle and Beamwith", IEEE Transactions on Microwave Theory and Techniques, Jan. 1, 2005, 161-173.

Caloz et al., "Transmission line approach of left-handed (LH) materials and microstrip implementation of an artificial LH transmission line", IEEE Transactions on Antennas and Propagation, May 2004, vol. 52, No. 5, 1159-1166.

Hashemi et al., "Electronically Controlled Metamaterial-Based Leaky-Wave Transmission-Line for Conformal Surface Applications", Microwave Symposium Digest, Jun. 7, 2009, 69-72.

Lei et al., "Dominant mode leaky-wave antenna with backfire-to-endfire scanning capability", Electronic Letters, Nov. 2002, vol. 38, 1414-1416.

Piazza et al., "Two port reconfigurable CRLH leaky wave antenna with improved impedance matching and beam tuning", Antennas and Propagation, Mar. 23, 2009, 2046-2049.

Sanada et al., "Characteristics of the composite right/left handed transmission lines", IEEE Microwave and Wireless Components Letters, Feb. 2004, vol. 14, No. 2, 68-70.

* cited by examiner

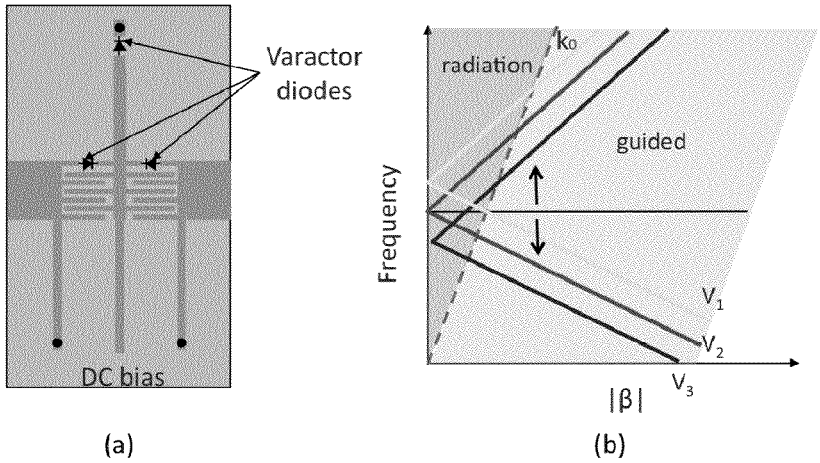
Fig. 3
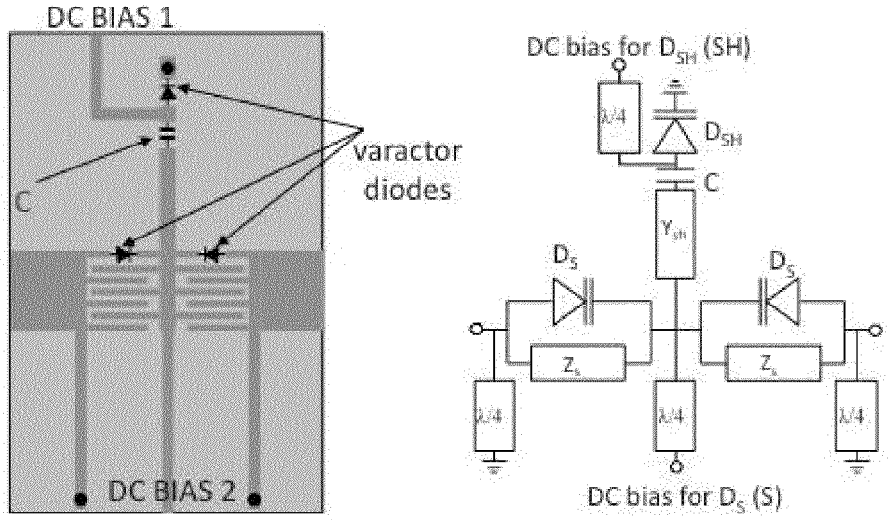
Fig.4 (a) (b)

10 Cells 2.44 GHz Port 1
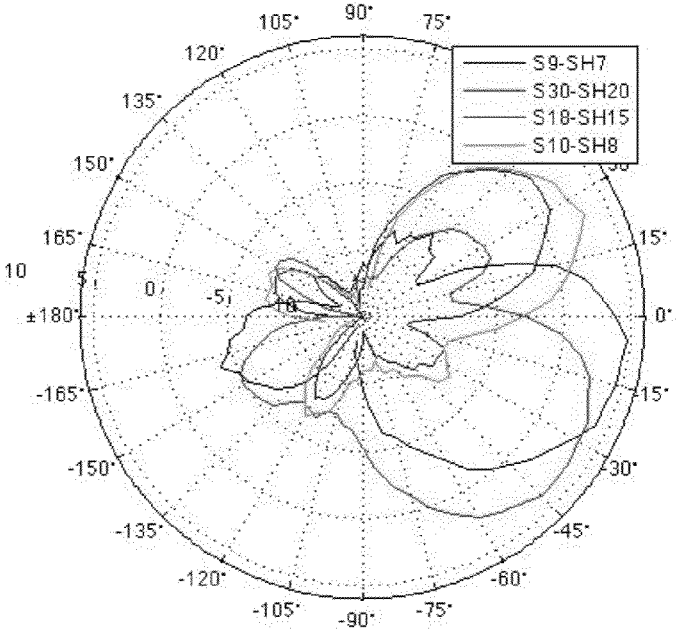
(a)
10 Cells 2.44 GHz Port 2
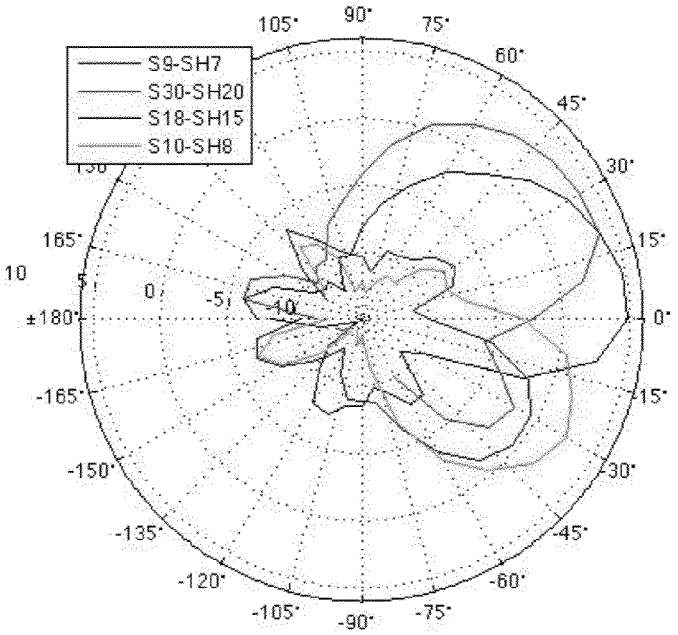
(b)
Fig. 8

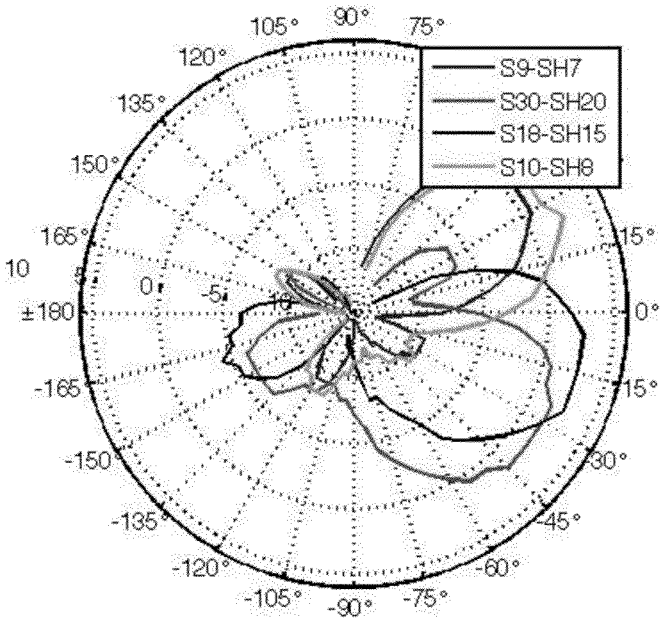
(a)
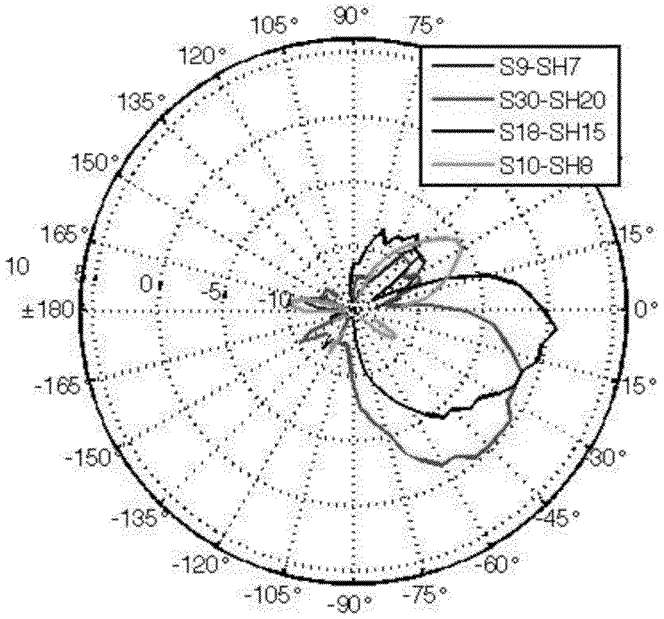
(b)
Fig. 9

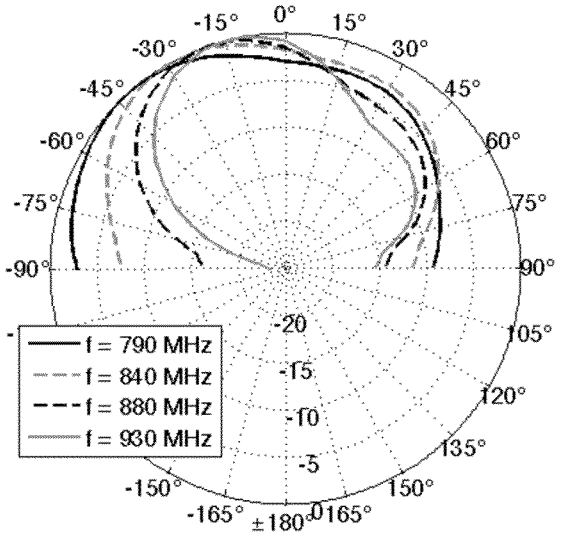
(a)
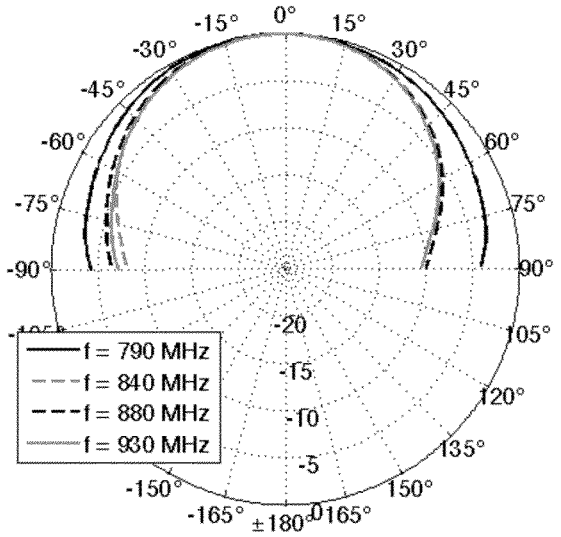
(b)
Fig. 13

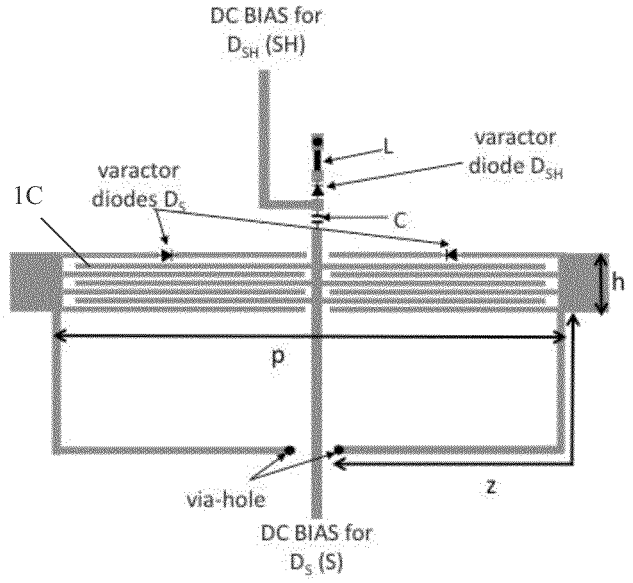
*(a)*
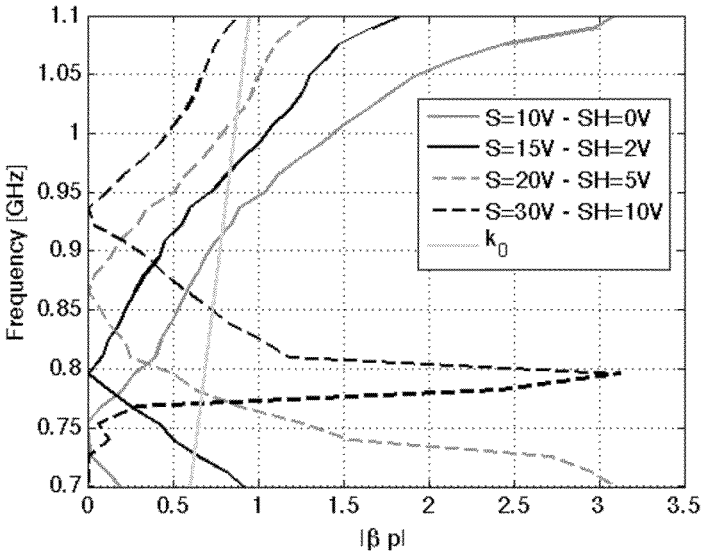
*(b)*
Fig. 14

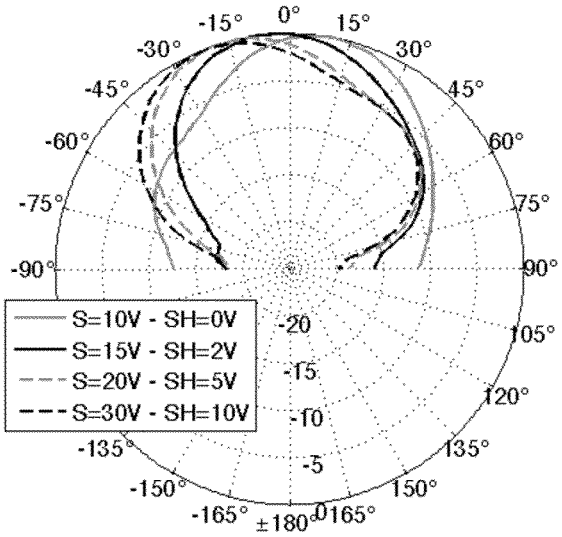
*(a)*
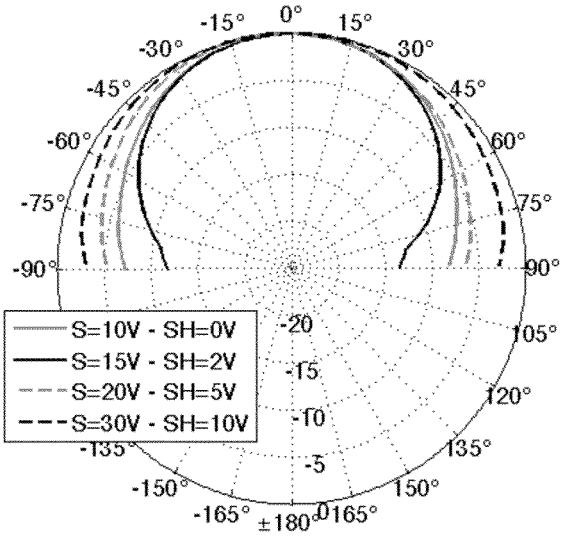
*(b)*
Fig. 16

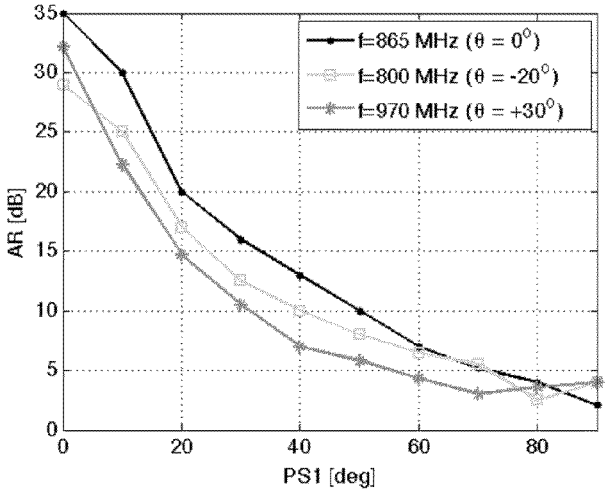
Fig. 19
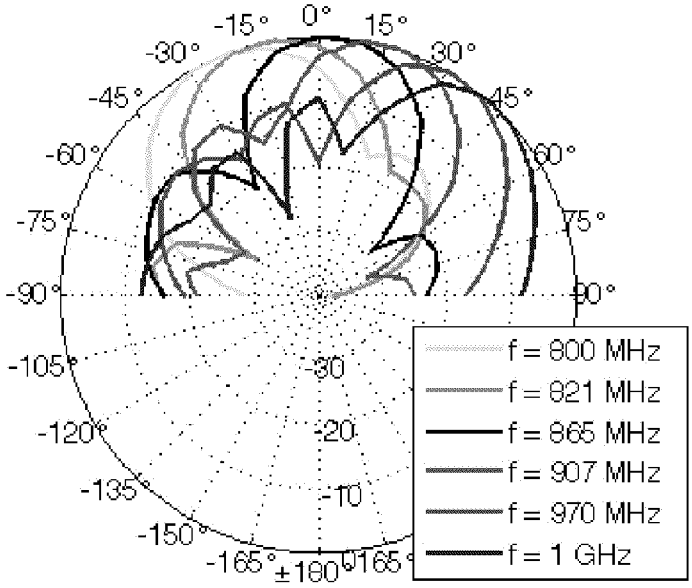
Fig. 20
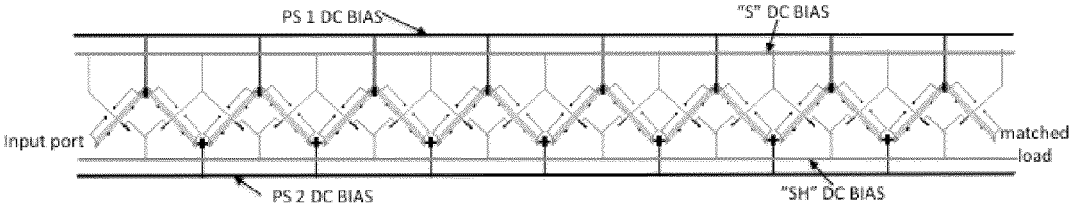

Fig. 21
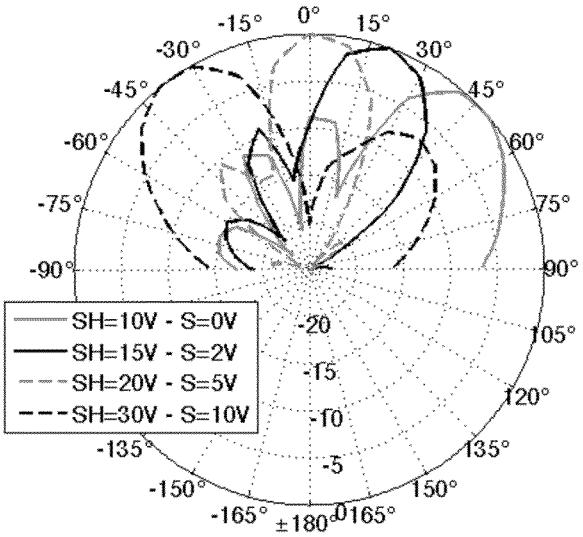
*(a)*
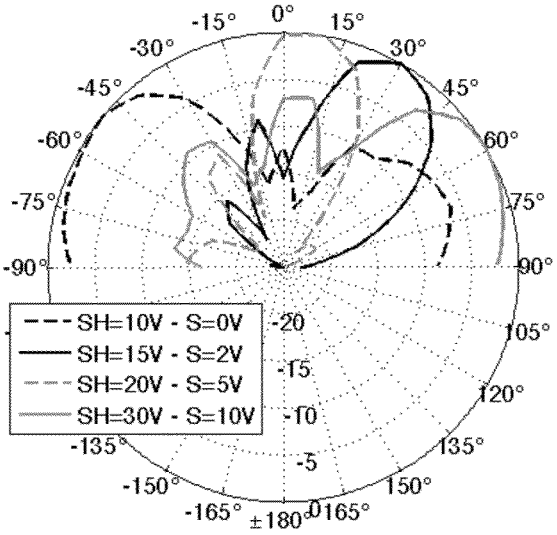
*(b)*
Fig. 22

METAMATERIAL RECONFIGURABLE ANTENNAS

CROSS REFERENCE TO RELATED APPLICATIONS

This application is a continuation of U.S. non-provisional application Ser. No. 13/516,229, filed Jun. 14, 2012, which is a U.S. national stage application of PCT/EP2010/007653, filed on Dec. 16, 2010, which claims priority to U.S. provisional application 61/286,786, filed on Dec. 16, 2009, the entireties of the disclosures of which are incorporated herein.

TECHNICAL FIELD

The present invention relates generally to the field of reconfigurable antennas. Specifically, the present invention relates to antennas that can be reconfigured in pattern and/or polarization by using metamaterial structures loaded with variable capacitor and inductors

BACKGROUND OF THE INVENTION

The changing behavior of the wireless channel causes fluctuations in the level of received signal power. In order to limit the effect of the varying wireless channel on system performance, a possible solution is to adopt reconfigurable antenna systems capable of adaptively tuning their radiation characteristics in response to the multivariate channel. Radiation pattern shape, polarization state and frequency of operation can be tuned to accommodate the operating requirements. Different solutions employing different techniques for reconfiguring the radiation characteristic have been proposed in the prior art.

Most of the proposed reconfigurable antennas achieve pattern and polarization reconfigurability by changing the current distribution on the antenna by means of RF switches embedded on the antennas, material changes or structural variations. Using these techniques allows generating different polarizations and radiation patterns but, especially when the antenna has several different configurations, it generally causes some of the antenna configurations to suffer of low gain or impedance mismatch. It is desired to overcome these issues and to achieve high gain pattern and polarization reconfigurable antennas that exhibit good impedance matching for all configurations. The present invention has been designed to address these and other needs in the art.

SUMMARY

To address the above-mentioned needs in the art, the invention described herein uses leaky wave antennas (LWAs) built using metamaterial structures loaded with tunable capacitors and inductors and specific DC bias networks to control the values of capacitance and inductance across the antenna. Three different reconfigurable antenna designs built using a LWA metamaterial structure are described. These antennas exploit the characteristics of Composite Right Left Handed (CRLH) materials to achieve high pattern and polarization reconfigurability, with good impedance matching in a compact antenna design.

In particular, the invention includes metamaterial reconfigurable antennas that uses varactor diodes to change characteristics of unit cell structures such as group delay of transmission lines, polarization and impedance, by changing the values of variable capacitors and/or inductors in response to independent DC biases provided by independent DC bias circuits. As they operate on a traveling wave and not a resonating wave basis, these antennas may enable significant improvements in gain and reconfigurability. By controlling the varactor diodes independently, the group delay, polarization and impedance may be more widely varied than standard unit cell structures that only change the group delay.

In exemplary embodiments, the invention comprises a pattern and/or polarization reconfigurable antenna comprising at least one Composite Right Left Handed (CRLH) unit cell including a standard transmission line with added series capacitance and shunt inductance and adapted to radiate an electrical field and at least a variable capacitance and/or inductance in series with the shunt inductance and at least a variable capacitance and/or inductance in parallel with the series capacitance, whereby the variable capacitance and/or inductance in series with the shunt inductance and the variable capacitance and/or inductance in parallel with the series capacitance are responsive to at least two DC biases used to independently control the variable capacitance and/or inductance in parallel with the series capacitance and the variable capacitance and/or inductance in series with the shunt inductance to thereby control the group delay of the transmission line and a polarization of the radiated electrical field. In an exemplary embodiment, the CRLH unit cell and the variable capacitance and/or inductance in series with the shunt inductance and the variable capacitance and/or inductance in parallel with the series capacitance are fabricated on a microwave laminate printed circuit board.

In different configurations of the antenna of the invention, multiple CRLH unit cells are cascaded to define a leaky wave structure that has at least two input ports for accepting excitation signals to excite the antenna. In an exemplary embodiment, at least one input port is used to feed the antenna with a radio frequency signal as the excitation signal and all other input ports are closed on a matched load. Also, two input ports may be connected to an RF switch that alternatively allows exciting one or the other of the two input ports.

In a first configuration of the reconfigurable antenna of the invention, the CRLH unit cells are cascaded along a straight line and the DC bias used to change the variable capacitance and/or inductance in parallel with the series capacitance is used to control the radiation angle while the DC bias used to change the variable capacitance and/or inductance in series with the shunt inductance is used to control the radiation angle, the polarization of the radiated electrical field, and impedance matching.

In a second configuration of the reconfigurable antenna of the invention, the CRLH unit cells are cascaded with a zigzag shape whereby respective CRLH unit cells are substantially orthogonal to each other and the DC bias used to change the variable capacitance and/or inductance in parallel with the series capacitance is used to control the radiation angle while the DC bias used to change the variable capacitance and/or inductance in series with the shunt inductance is used to control the radiation angle, the polarization of the radiated electrical field, and impedance matching. Preferably, the CRLH unit cells are interleaved with a variable phase shifter that dynamically controls the polarization of the radiated electrical field. Also, a capacitor may be used in an exemplary configuration to decouple respective DC bias networks that generate the two DC biases.

In a third configuration of the reconfigurable antenna of the invention, the CRLH unit cells are cascaded along a circular arc and the DC bias used to change the variable capacitance and/or inductance in parallel with the series capacitance is used to control the polarization of the radiated field while the DC bias used to change the variable capacitance and/or inductance in series with the shunt inductance is used to control the polarization of the radiated field and impedance matching. In an exemplary configuration, pairs of the CRLH unit cells are displaced orthogonally in space along the circular arc. A capacitor may also be included in the circuit to decouple respective DC bias networks that generate the at least two DC biases.

The invention also includes methods of varying pattern and/or polarization of a reconfigurable antenna by providing at least one Composite Right Left Handed (CRLH) unit cell including a standard transmission line with added series capacitance and shunt inductance and adapted to radiate an electrical field and at least a variable capacitance and/or inductance in series with the shunt inductance and at least a variable capacitance and/or inductance in parallel with the series capacitance and separately applying at least two DC biases to the variable capacitance and/or inductance in series with the shunt inductance and the variable capacitance and/or inductance in parallel with the series capacitance to independently control the variable capacitance and/or inductance in parallel with the series capacitance and the variable capacitance and/or inductance in series with the shunt inductance so as to thereby control the group delay of the transmission line and a polarization of the radiated electrical field. Multiple CRLH unit cells are cascaded to define a leaky wave structure, and excitation signals are applied to at least one input port of the leaky wave structure to excite the antenna. At least one input port is fed with a radio frequency signal as the excitation signal while all other input ports are closed on a matched load. Also, two input ports may be alternately excited by selectively opening and closing an RF switch between the two input ports.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

Exemplary embodiments of the invention will be described in connection with the associated figures, of which:

FIG. 3 illustrates a reconfigurable CRLH transmission line unit cell schematic (FIG. 3(*a*)) and dispersion diagram (FIG. 3(*b*)).

FIG. 4 illustrates a CRLH tunable unit cell with independent biasing networks and good impedance matching schematic (FIG. 4(*a*)) and circuit model (FIG. 4(*b*)) in accordance with the invention.

FIG. 8 illustrates measured radiation patterns excited at the two ports of the reconfigurable LWA for four different configurations at port 1 (FIG. 8(*a*)) and at port 2 (FIG. 8(*b*)) at a frequency of 2.44 GHz.

FIG. 9 illustrates measured radiation patterns excited at port 1 of the reconfigurable LWA for four different configurations for vertical polarization (FIG. 9(*a*)) and horizontal polarization (FIG. 9(*b*)) at a frequency of 2.44 GHz.

FIG. 13 illustrates radiation patterns for different frequency of operations where the mean beam direction is independent from the polarization/propagation constant for (a) $\phi$=0° and (b) $\phi$=90°.

FIG. 14 illustrates a CRLH reconfigurable unit cell schematic (FIG. 14(*a*)) and a dispersion diagram (FIG. 14(*b*)) for different values of applied voltages "S" and "SH".

FIG. 16 illustrates radiation patterns for four different configurations of the LWA with frequency independent polarization reconfigurability for (a) $\phi$=0° and (b) $\phi$=90° at a frequency of 880 MHz.

FIG. 19 illustrates axial ratio for three different angles of radiation at the frequencies of 800 MHz, 865 MHz and 970 MHz for different values of phase shift (PS1=−PS2).

FIG. 20 illustrates radiation patterns for different frequencies of operation illustrating that under the condition PS1=−PS2 the beam direction is independent from the applied phase shift.

FIG. 21 illustrates an embodiment of the polarization reconfigurable LWA with frequency independent beam scanning capabilities.

FIG. 22 illustrates radiation patterns for four different configurations of the reconfigurable LWA with frequency independent beam scanning capabilities for (a) 2p=d and (b) 2p/d=1.2 for a frequency of 880 MHz.

DETAILED DESCRIPTION OF ILLUSTRATIVE EMBODIMENTS

A detailed description of illustrative embodiments of the present invention will be described below with reference to FIGS. 1-23. Although this description provides detailed examples of possible implementations of the present invention, it should be noted that these details are intended to be exemplary and in no way delimit the scope of the invention.

A leaky wave is a traveling wave that progressively leaks out power while it propagates along a waveguiding structure. Such structures are usually used as antennas to achieve high directivity. Leaky wave antennas are fundamentally different from resonating antennas in the sense that they are based on a traveling wave as opposed to a resonating wave mechanism. Significantly, the antenna size is not related to the antenna resonant frequency but to its directivity.

The radiation properties of a leaky wave antenna are related to the propagation constant along the direction of the waveguide, $\gamma=\alpha-j\beta$ (where $\alpha$ is the attenuation constant and $\beta$ is the phase constant), and to the propagation constant perpendicular to this direction, $k\perp$. The two propagation constants are related as:

$$k_{\perp}=\sqrt{k_0^2-\beta^2}$$

where $k_0$ is the free space wave number.

If the wave is slower than the velocity of light (slow wave region) and so $k_0<\beta$, the perpendicular propagation constant, $k\perp$, is imaginary and therefore no radiation occurs, and the wave is guided. If, in contrast, the wave is faster than the velocity of light (fast wave region) and so $k_0>\beta$, the perpendicular propagation constant is real and radiation occurs. In particular, radiation occurs under the angle $$\theta=\sin^{-1}\left(\frac{\beta}{k_0}\right)$$

where $\theta$ is the maximum beam angle from the broadside direction. Thus, the radiation angle can be controlled by frequency in a leaky wave antenna. The attenuation constant, $\alpha$, determines instead the radiated power density per unit length. For large values of $\alpha$ most of the power is leaked in the first part of the waveguiding structure, while for small values of a, leakage occurs slowly and highly directivity is achieved.

Figure 1:
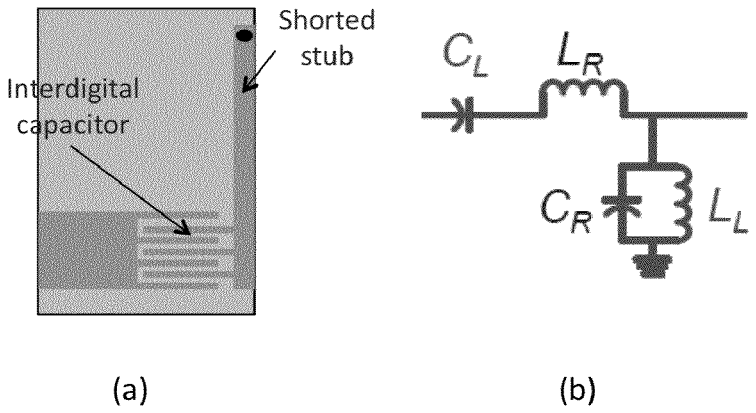
FIG. 1 illustrates a Composite Right Left Handed (CRLH) transmission line unit cell schematic (FIG. 1(*a*)) and equivalent circuit model (FIG. 1(*b*)).
Figure 2:
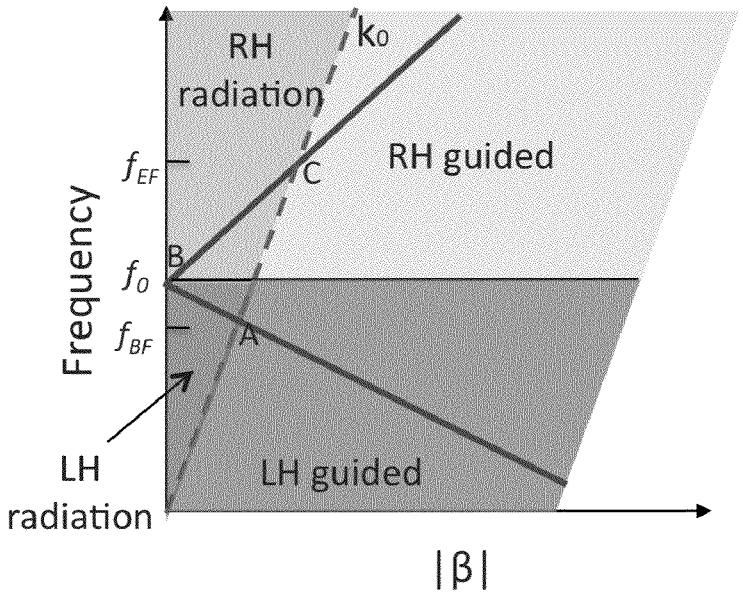
FIG. 2 illustrates a dispersion diagram of a CRLH transmission line unit cell.

A dominant mode frequency-scanned LW antenna can be implemented using composite right left handed (CRLH) transmission lines. A CRLH transmission line is implemented by inserting an artificial series capacitance and a shunt inductance into a conventional transmission line which has an intrinsic series inductance and shunt capacitance. The general representation of the CRLH transmission line and its equivalent circuit model are shown in FIG. 1. As illustrated, the CRLH transmission line includes an interdigital capacitor and a shorted shunt stub representing a series capacitance and a shunt inductance, respectively.

Loading a common transmission line with a series capacitance and shunt inductance allows for the creation of a metamaterial that modifies the typical propagation characteristic of right handed (RH) materials which are characterized by a positive propagation constant, $\beta>0$. In CRLH transmission lines the material propagation behavior shifts with frequency from RH (characterized by $\beta>0$) to left handed (LH) (characterized by $\beta<0$). This effect has been demonstrated by Caloz et al. in "Transmission line approach of left-handed (LH) materials and microstrip implementation of an artificial LH transmission line," IEEE Transactions on Antennas and Propagation, Vol. 52, No. 5, pp. 1159-1166 (2004) and by Lai et al. in "Composite right/left-handed transmission line metamaterials," IEEE Microwave Magazine, Vol. 5, No. 3, pp. 34-50 (2004) and it can be observed in the dispersion diagram of FIG. 2. According to the CRLH transmission line dispersion diagram of FIG. 2, there are four distinct regions: the LH-guided region, the LH-leaky region, the RH-leaky region and the RH-guided region. This backfire to endfire scanning capability, first demonstrated experimentally by Sanada et al. in "Characteristics of the composite right/left-handed transmission lines," IEEE Microwave and Wireless Components Letters, Vol. 14, No. 2, pp. 68-70 (2004) and explained by the CRLH concept by Caloz et al. in "A novel composite right/left-handed coupled-line directional coupler with arbitrary coupling level and broad bandwidth," IEEE Transactions on Microwave Theory and Techniques, Vol. 52, No. 3, pp. 980-992 (2004), is a very unique feature for a LWAs, which cannot be obtained in conventional leaky wave structures.

The frequency scanned nature of these LWA is, however, a disadvantage that has limited their applications in modern communication systems, generally requiring fixed frequency operation for effective channelizing. In CRLH LWA, since the main radiation beam angle is a function of the propagation constant along the structure, it is possible to steer the beam by LC parameters tuning at a fixed frequency of operation. In this case, varactor diodes can be integrated along the structure, in each cell, to provide continuously variable capacitances or variable inductance via the control of their reverse bias voltage V. A first prototype of an electronically scanned CRLH LWA has been proposed by Sungjoon et al. in "Metamaterial-based electronically controlled transmission-line structure as a novel leaky-wave antenna with tunable radiation angle and beamwidth," IEEE Transactions on Microwave Theory and Techniques, Vol. 52, December 2004, and its working principle is described in the dispersion diagram of FIG. 3(*b*) for the reconfigurable CRLH transmission line unit cell generally illustrated in FIG. 3(*a*). As illustrated, by varying the applied bias voltage V, it is possible to shift the propagation characteristics of the transmission line and achieve different propagation constants, $\beta$, for a fixed frequency of operation.

The unit cell structure presented by Sungjoon et al. has been demonstrated to be effective for building LWAs that allow changing the direction in which the beam is steered. However, LWAs built using this type of unit cell suffer from a gain imbalance between the different configurations. The design of CRLH unit cells presented by Sungjoon et al. is conceived to have $l<<\lambda_g$, with $\lambda_g$ being the guided wavelength and l the unit cell length, and to have variable capacitance controlled simultaneously through a single DC bias. Using this design, several unit cells need to be used in order to achieve good directionality, and this causes the antenna to have low gain for configurations that do not point in broadside as well as insufficient impedance matching. Also, to date the properties of CRLH materials have been used to build LWAs capable only of steering the beam continuously from end-fire to back-fire.

The invention relates to a novel structure of CRLH unit cell that allows for exploitation of the characteristic behavior of CRLH to build LWAs capable of simultaneously changing pattern and polarization while preserving good impedance matching and high gain for all the antenna's configurations. An exemplary embodiment of an exemplary embodiment of the metamaterial unit cell structure of the invention is shown in FIGS. 4(*a*) and 4(*b*). In order to achieve CRLH behavior, the unit cell of FIG. 4 is designed by inserting an artificial series capacitance and a shunt inductance into a conventional microstrip line by means of an interdigital capacitor and a shorted stub respectively. To dynamically tune the handedness of the unit cell, two varactor diodes ($D_S$) are placed in parallel with the microstrip series interdigital capacitor and one varactor diode ($D_{SH}$) is placed in series with the shunt inductor. Two independent bias networks are used to separately tune the varactors $D_S$ ("S" bias) and $D_{SH}$ ("SH" bias). A capacitor (C=0.5 pF) is used to decouple the two DC bias networks, and quarter wave transformers are employed to prevent the RF signal from flowing to DC ground. By using two independent DC bias networks, it is possible to adjust the unit cell reactance in order to keep the Bloch impedance close to 50Ω while shifting the unit cell electrical characteristic from left hand to right hand. Moreover, the use of a separate $D_{SH}$ ("SH" bias) bias network allows changing the unit cell polarization. This property can effectively be used to also control the polarization in CRLH LWAs.

The CRLH unit cell, differently from any proposed approach, needs to have $l \sim \lambda_g/4$ while preserving the characteristic CRLH behavior. Using unit cells with size comparable to $\lambda_g/4$ allows building high gain LWAs composed of few unit cells with overall low losses introduced by the active components. This technique allows building active LWAs with strong gain.

Three exemplary embodiments of pattern and polarization reconfigurable antennas have been designed using this type of CRLH unit cell structure. The working principle of these antennas is unique and is part of this invention.

Antenna Design 1

A leaky wave antenna (LWA) in accordance with antenna design 1 uses composite right left handed (CRLH) materials in order to achieve high radiation pattern and polarization reconfigurability without sacrificing gain, impedance matching, or compactness. Two separate ports are located on the same antenna structure so that a single physical antenna can be used as a two elements array for reduced antenna space occupation on the communication device. The leaky wave antenna is composed of N cascaded CRLH unit cells. An embodiment of this unit cell is built on Rogers substrate with a length, l, of 13 mm. Skyworks SMV1413 varactor diodes with a measured capacitance that varies continuously from 1.3 pF (for a bias voltage of 40 Volts) to 7.3 pF (for a bias voltage of 0 Volt) are used.

Figure 5:
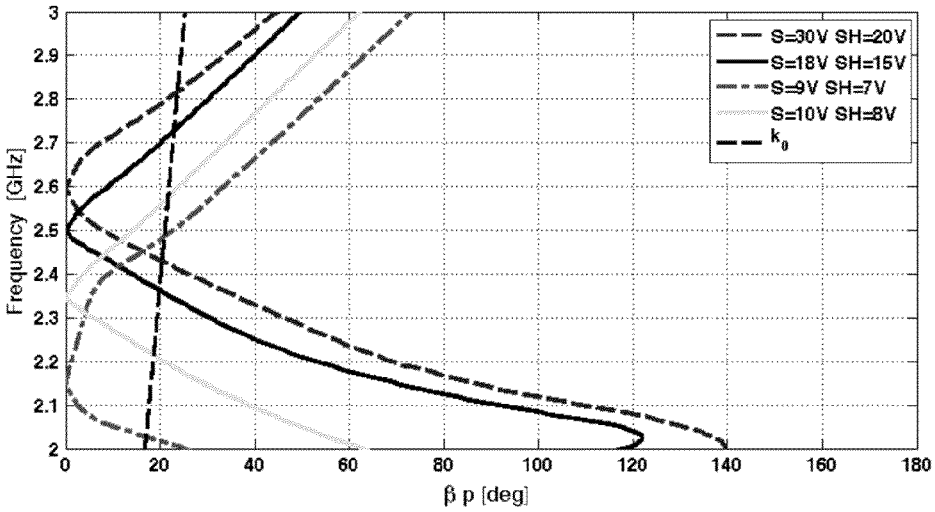
FIG. 5 illustrates a dispersion diagram of the unit cell of the invention for four different bias voltage combinations.

FIG. 5 shows the measured dispersion diagram of the proposed unit cell for four different configurations of "S" and "SH" DC bias voltages. Table I shows the measured Bloch impedance for the same voltage combinations at a frequency of 2.44 GHz. It will be appreciated that this unit cell design allows for continuous shifting of the propagation constant, β, for a fixed frequency of operation while keeping the Bloch impedance close to 50Ω. This unit cell design is then suitable for building reconfigurable CRLH LWAs with good matching over the entire set of generated scanning beams. For a selected frequency of operation, in the fast wave region of the unit cell, $\beta < k_0$, radiation occurs at the angle:

$$0 = \sin^{-1}\left(\frac{\beta}{k_0}\right)$$

where θ is the radiation angle and $k_0$ is the free-space wavenumber.

TABLE I

| CONFIGURATION | IMPEDANCE [Ω] |
|---|---|
| S = 9 V SH = 7 V | 45 + j5 |
| S = 30 V SH = 20 V | 65 + j7 |
| S = 18 V SH = 15 V | 40 + j10 |
| S = 10 V SH = 8 V | 43 + j4 |

Figure 6:
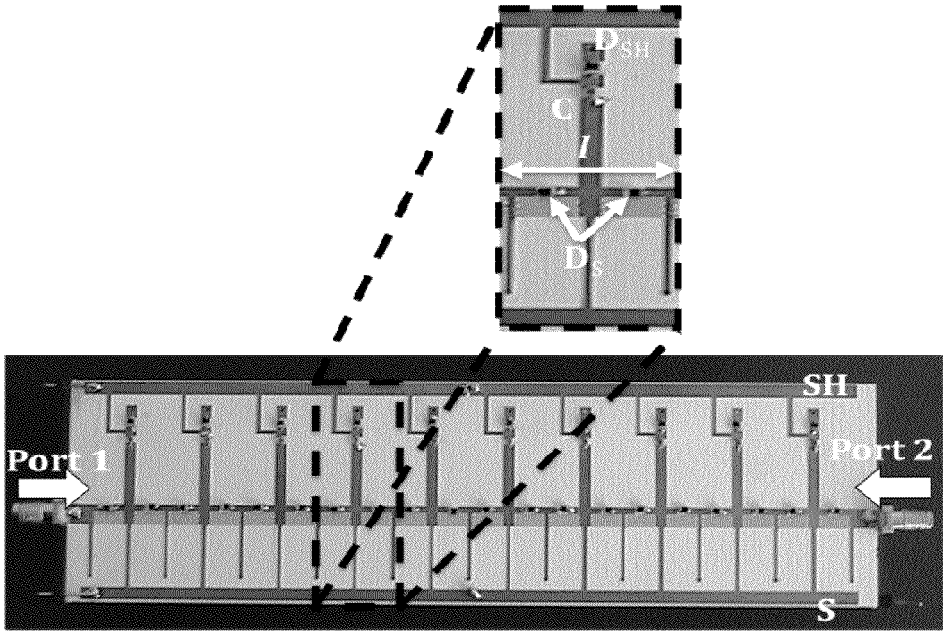
FIG. 6 illustrates a two port reconfigurable leaky wave antenna (LWA) for use in accordance with the invention.
Figure 7A:
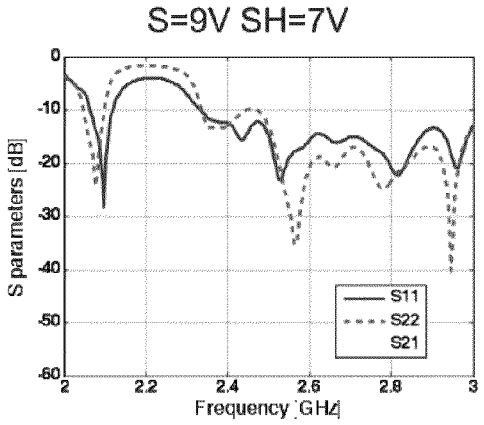
FIGS. 7(*a*)-7(*d*) illustrate measured scattering parameters for four different configurations of the reconfigurable LWA used in accordance with the invention.
Figure 7B:
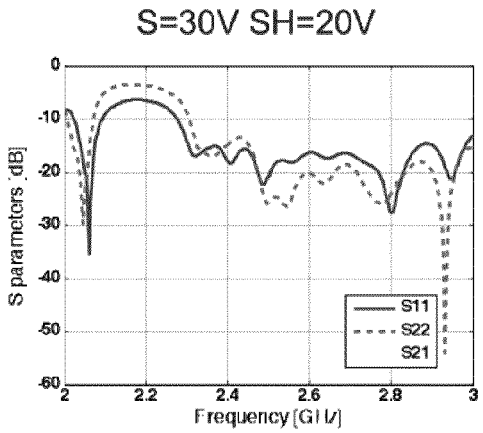
Figure 7C:
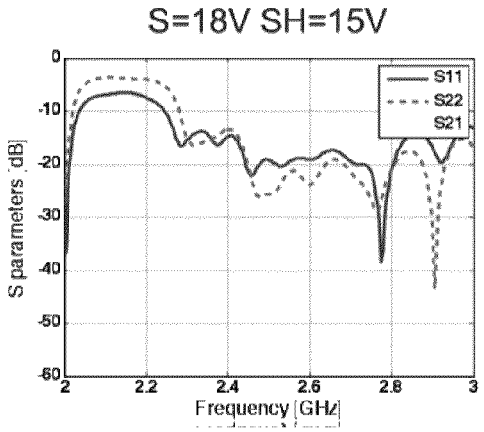
Figure 7D:
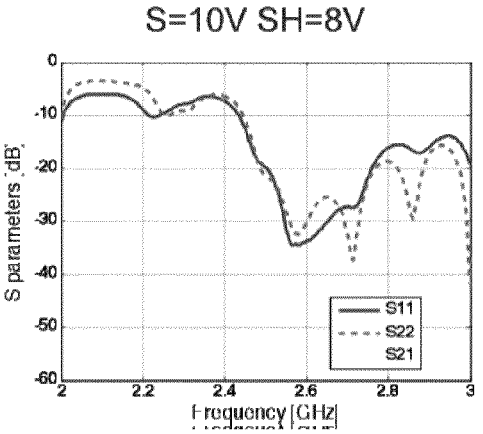

FIG. 6 shows a prototype of a two port reconfigurable leaky wave antenna built with the unit cell structure having the dispersion diagram illustrated in FIG. 5. The antenna includes 10 unit cells and has been designed to operate at the frequency of 2.44 GHz. The design is 14 cm long and it allows for excitation of two independent beams (one per port) that can be steered from backfire to endfire. Since a common antenna structure is used for the two ports, the excited beams are steered together symmetrically with respect to the broadside direction. Ideally, since the varactor capacitance allows for continuous tuning, an infinite number of configurations can be selected for the antenna.

FIGS. 7(*a*)-7(*d*) show the measured scattering parameters for four different array configurations (each corresponding to a specific combination of "S" and "SH" voltages). Both ports are matched at the frequency of 2.44 GHz with respect to a 10 dB target return loss. The isolation between the two ports is higher than 10 dB for all the configurations.

FIG. 8 shows the measured radiation patterns excited at port 1 (FIG. 8(*a*)) and at port 2 (FIG. 8(*b*)) at a frequency of 2.44 GHz for the same four different array configurations of FIGS. 7(*a*)-7(*d*). As illustrated, the beam can be effectively steered over 90° in the elevation plane with minor differences between the two ports. The beam scanning direction of the proposed antenna structure can be predicted using the dispersion diagram information as:

$$\theta_1 = \sin^{-1}\left(\frac{\beta(S, SH)}{k_0}\right) = -\theta_2$$

where $\theta_1$ and $\theta_2$ are the scanning angles at port 1 and port 2. As summarized in Table II, the antenna measured scanning direction agrees well with the one predicted using the measured propagation constant of a single unit cell.

FIG. 9 shows the measured radiation patterns for the vertical polarization (FIG. 9(*a*)) and horizontal polarization (FIG. 9(*b*)) at a frequency of 2.44 GHz excited at one port of the LWA. It can be noted that using an independent DC bias ("SH") to change the values of shunt capacitance, the polarization of the antenna can be effectively changed for a given pointing direction. The antenna can then also be used to change the polarization of the radiated beam while changing its pointing direction.

TABLE II

| | | 2.4 GHz | | | 2.44 GHz | | | 2.48 GHz | | |
|---|---|---|---|---|---|---|---|---|---|---|
| S [V] | SH [V] | Est. Angle [deg] | Measured [deg] | RL [dB] | Est. Angle [deg] | Measured [deg] | RL [dB] | Est. Angle [deg] | Measured [deg] | RL [dB] |
| 30 | 20 | −42 | −60 | 16 | −17 | −40 | 12 | −4 | −10 | 15 |
| 10 | 8 | 30 | 20 | 14 | 48 | 25 | 17 | 68 | 40 | 17 |
| 18 | 15 | −16.5 | −25 | 12 | −2.5 | −10 | 12 | 0.7 | −5 | 5.3 |
| 9 | 7 | 53 | 30 | 11 | 83 | 35 | 15 | >90 | 45 | 20 |

Antenna Design 2

In this embodiment, the properties of CRLH materials are exploited to achieve polarization tunability in leaky wave antennas with broadside radiation.

Figure 10:
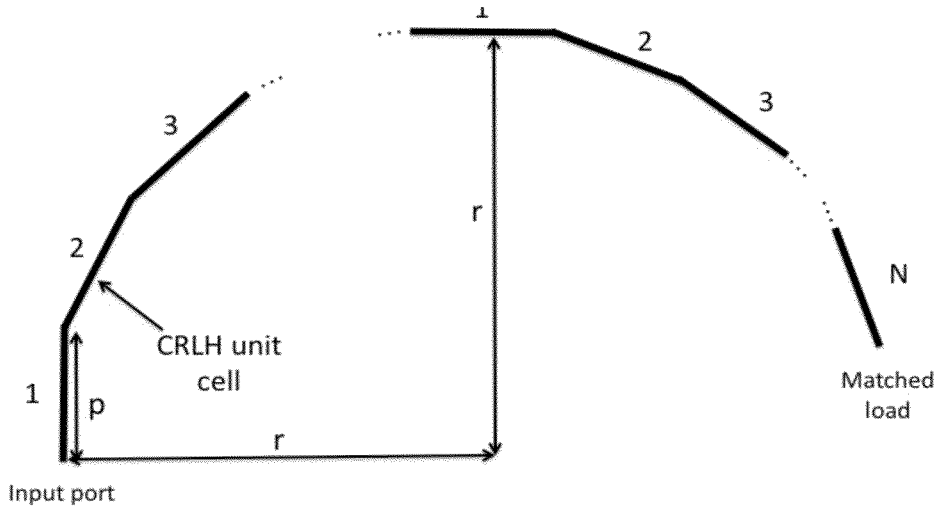
FIG. 10 illustrates a schematic of the polarization reconfigurable LWA of the invention where pairs of cells with the same number are orthogonal in space.

A LWA antenna with variable polarization can be designed by cascading N CRLH unit cells with linear polarization along a semi-circumference as shown in FIG. 10. The N cells are arranged in that shape to achieve variable polarization depending on the value of the unit cell propagation constant β, and a frequency/polarization independent broadside radiation pattern. Pairs of cells are displaced orthogonally in space along the semi-circumference, as shown in FIG. 10, to obtain two orthogonal electric field components.

The difference in phase excitation between each cell that constitutes a pair (e.g. the orthogonal cells marked as 1 in FIG. 10) is a function of the unit cell propagation constant and it determines the polarization of the radiated field. A phase difference of 0° between two orthogonal cells is achieved for β=0°, and the LWA radiates in broadside with linear polarization (LP). In the left hand region (β<0°) the antenna radiates with right hand (RH) polarization while in the right hand region (β>0°) it radiates with left hand (LH) polarization. The phase difference, Δϕ, of the excitation of two orthogonal unit cells is given by:

$$\Delta\phi=-(K+1)\beta p$$

where K is the number of CRLH unit cells that separates the two orthogonal cells. The difference in amplitude, ΔI, between the excitation of two orthogonal unit cells is defined as:

$$\Delta I=I_0(1-e^{-(K+1)\alpha p})$$

where $I_0$ is the current at the input port of the LWA and α is the attenuation constant of the CRLH TL. Since two orthogonal unit cells cannot be excited with equal magnitude, pure circular polarization cannot be generated.

Figure 11:
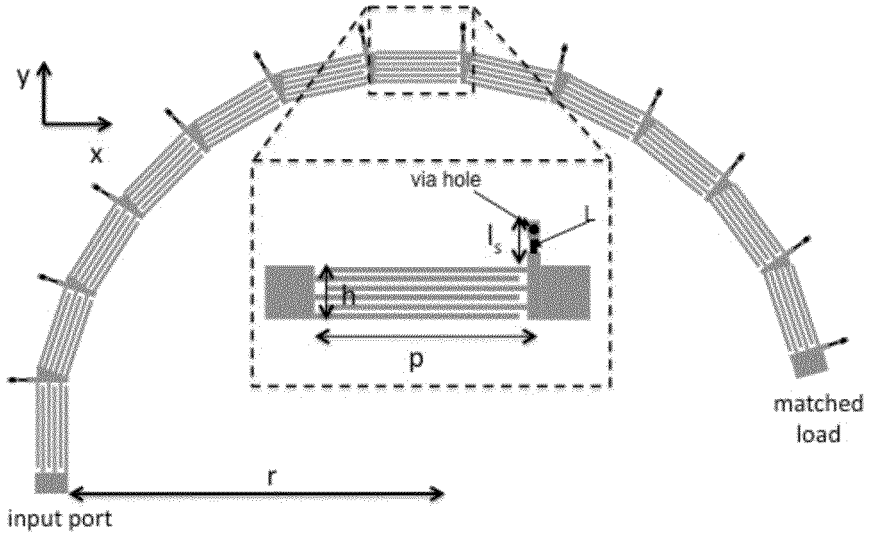
FIG. 11 illustrates an embodiment of the LWA of FIG. 10 with frequency dependent polarization reconfigurability.

An exemplary embodiment of this antenna structure is a LWA with frequency dependent polarization reconfigurability. The design of the CRLH unit cell for this embodiment is shown in FIG. 11. To achieve the desired CRLH behaviour, the unit cell is designed using an interdigital capacitor and a shunt lumped inductor. A lumped inductor is used instead of a longer shorted stub to design a unit cell with strong linear polarization.

As illustrated in FIG. 11, N=12 unit cells are cascaded along a semi-circumference. The antenna, built on a Rogers 4003C substrate, is fed at one port while the other port is closed on a matched load. The main structural parameters of the antenna are shown in Table III.

TABLE III

STRUCTURAL PARAMETERS OF THE LWA WITH FREQUENCY DEPENDENT BEAM SCANNING CAPABILITIES

| | |
|---|---|
| p | 31.6 mm |
| $l_s$ | 4.5 mm |
| L | 6 nH |
| h | 3.3 mm |
| $\epsilon_r$ | 3.55 |
| r | 12.9 cm |

Figure 12:
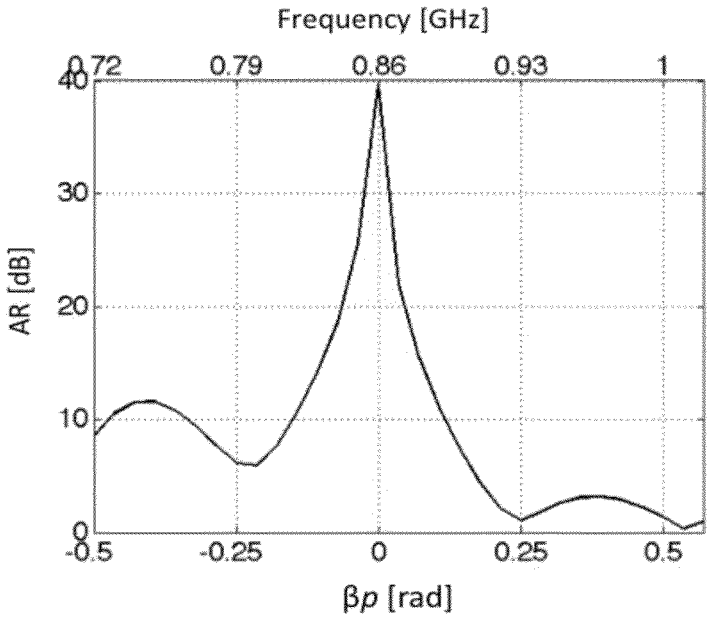
FIG. 12 illustrates axial ratio as function of the propagation constant $\beta$ for a CRLH cell configuration where the linear polarization condition ($\beta$=0 rad/m) is obtained at the frequency of 840 MHz.

FIG. 12 illustrates the LWA axial ratio as a function of the unit cell propagation constant, β, in the broadside direction. The antenna polarization can be continuously changed from right hand circular polarization (RHCP) to left hand circular polarization (LHCP) by varying the frequency of operation. The axial ratio can be tuned to 1 dB (LHCP) at the frequency of 930 MHz (βp=0.25 rad that corresponds to a phase difference of −90° between each pair of orthogonal cells), 40 dB (LP) at the frequency of 860 MHz (βp=0 rad that corresponds to a phase difference of 0° between each pair of orthogonal cells) and 6 dB (RH elliptical polarization) at the frequency of 790 MHz (MHz (βp=−0.25 rad that corresponds to a phase difference of 90° between each pair of orthogonal cells). An imbalance between the axial ratios of the RH and LH regions is due to the asymmetric structure of the unit cell.

The semi-circular shape allows also for broadside radiation independently from the frequency of operation. FIG. 13 shows the simulated radiation patterns of the antenna for different frequencies of operation where the mean beam direction is independent from the polarization/propagation constant for (a) ϕ=0° and (b) ϕ=90°. As illustrated, the antenna gain is constant independently from the radiated polarization and it falls in the range [0, +1] dBi. The return loss is less than 10 dB in the UHF band (790 MHz-930 MHz).

Another exemplary embodiment of this antenna structure is a LWA with frequency independent polarization reconfigurability. Loading the CRLH unit cell with varactor diodes, the propagation characteristics of the CRLH transmission line (TL) can be varied for a given frequency of operation.

The modified CRLH unit cell is shown in FIG. 14(*a*). As illustrated, two varactor diodes, $D_S$, are placed in parallel with the microstrip series interdigital capacitor IC and one varactor diode $D_{SH}$ is placed in series with the shunt inductor L. Two independent bias networks are used to separately tune the varactors $D_S$ ("S" voltage) and $D_{SH}$ ("SH" voltage). A capacitor C (C=0.5 pF) is used to decouple the two DC bias networks. The CRLH unit cell is built on Rogers 4003 substrate and the scattering parameters of Skyworks SMV1413 varactor diodes have been used together with simulations based on the method of moments to determine the electrical properties of the CRLH unit cell. The capacitance of the selected varactor diodes can be tuned from 10.1 pF to 1.6 pF to vary the applied voltage from 0V to 30V at the frequency of 880 MHz. The simulated dispersion diagrams of the reconfigurable CRLH of FIG. 14(*a*) are shown in FIG. 14(*b*) for different values of applied voltages "S" and "SH". It will be appreciated that the propagation constant, β, varies with the applied DC bias for the same frequency of operation.

Figure 15:
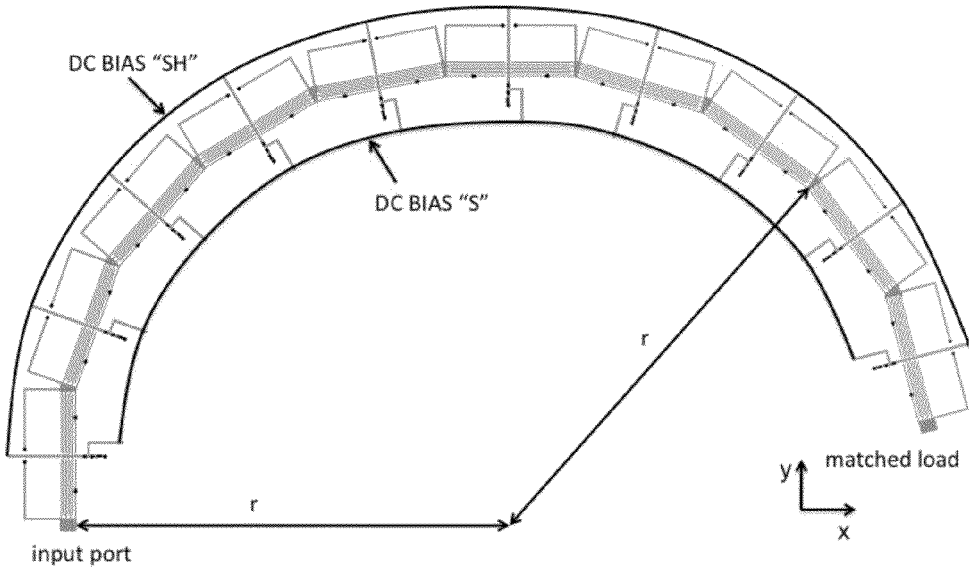
FIG. 15 illustrates an embodiment of the LWA with frequency dependent polarization reconfigurability.

As shown in FIG. 15, N=10 cells are cascaded along a semi-circumference to obtain a polarization reconfigurable LWA. The LWA is capable of changing the polarization state of the radiated field by properly tuning the applied voltages "S" and "SH" while radiating in broadside. FIG. 16 shows the simulated radiation patterns of the antenna with frequency independent polarization reconfigurability for different configurations of applied voltages for (a) ϕ=0° and (b) ϕ=90° at a frequency of 880 MHz. Table IV reports the axial ratios and the gains of four different configurations. The antenna is capable of changing the polarization of the radiated field from linear (configuration "SH=20V−S=5V") to circular (RHCP for configuration "SH=30V−S=10V", LHCP for configuration "SH=15V−S=2V"). However, the structure suffers from low gain that can be increased by using more unit cells displaced along a semi-circumference of longer radius.

TABLE IV

AXIAL RATIO AND GAIN FOR DIFFERENT CONFIGURATIONS OF THE RECONFIGURABLE LWA. FREQUENCY = 880 MHZ

| Configuration | AR [dB] | Gain [dBi] |
|---|---|---|
| S = 10 V − SH = 0 V | 14.2 | 0.8 |
| S = 15 V − SH = 2 V | 2.2 | 1.1 |
| S = 20 V − SH = 5 V | 21.4 | 2.8 |
| S = 30 V − SH = 10 V | 2.7 | 0.5 |

Antenna Design 3

The antenna design of this embodiment includes a reconfigurable leaky wave antenna (LWA) that takes advantage of the CRLH properties to achieve full pattern and polarization reconfigurability.

Figure 17:
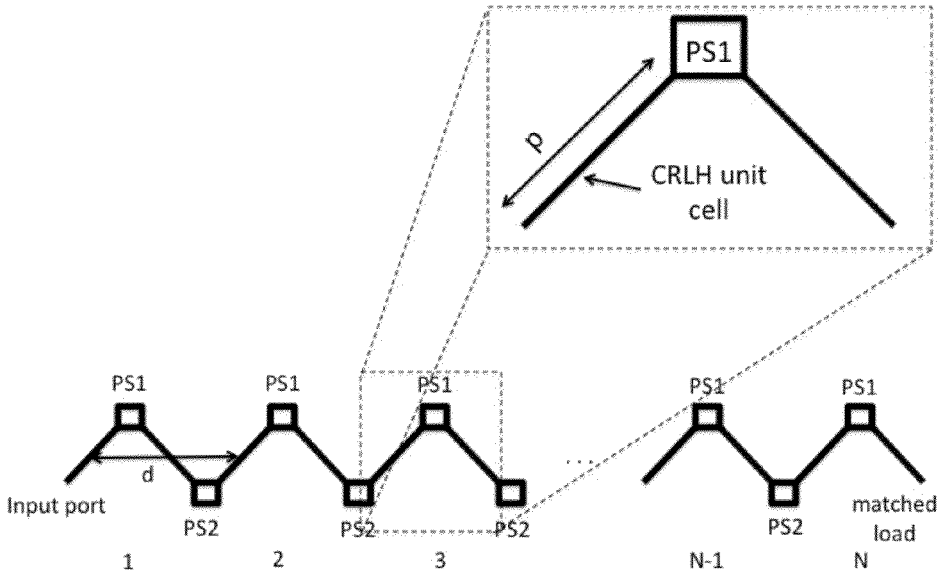
FIG. 17 illustrates a schematic of a pattern and polarization reconfigurable CRLH LWA in accordance with the invention.

In this embodiment, two consecutive CRLH unit cells characterized by linear polarization are displaced orthogonally, in V shape, as shown in FIG. 17, to radiate two orthogonal electric fields. A variable phase shifter (PS1) placed across two consecutive unit cells allows control of the phase difference between the two arms of the V structure. By properly adjusting the phase shift from −90° to +90°, the polarization of the V structure can be changed (in the broadside direction) from right hand to left hand circular. Linear polarization is achieved for a phase shift of 0°. In the embodiment of FIG. 17, a pattern and polarization reconfigurable LWA is obtained by cascading N V cells interleaved with a variable phase shifter, PS2, used to compensate the phase shift introduced by PS1.

This zigzag LWA of FIG. 17 is equivalent to an array of non directive radiating elements with variable polarization (V cells) and inter-element spacing d. The phase excitation, $\xi_n$, of the n-th array element is:

$$\xi_n = -(n-1)2\beta p$$

and the current excitation, $I_n$, is $$I_n = I_0 e^{-(n-1)2\alpha p}$$

where $I_0$ is the current at the input port of the LWA and α is the attenuation constant of the CRLH TL. The maximum radiation angle, θ, of such LWA can be predicted as:

$$\theta = \sin^{-1}\left(\frac{2\beta p}{k_0 d}\right).$$

The beam direction of this LWA is controlled through the TL propagation constant, β, while the polarization of the radiated field can be dynamically varied through the phase shifters, PS1 and PS2. In this design, unlike in conventional CRLH LWAs, it is possible to achieve end-fire radiation for values of $0<\beta<1$ and back-fire radiation for values of $-1<\beta<0$ by properly setting the ratio 2p/d.

Figure 18:
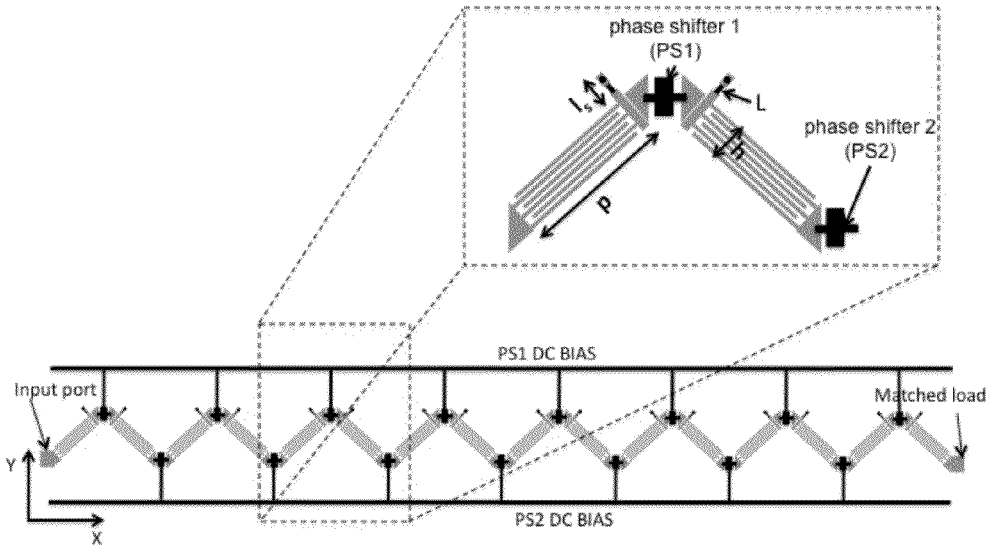
FIG. 18 illustrates an embodiment of a polarization reconfigurable LWA with frequency dependent beam scanning capabilities.

An exemplary embodiment of this antenna structure is a LWA with frequency dependent pattern reconfigurability. The design of the CRLH unit cell for this preferred embodiment is shown in FIG. 18. FIG. 18 shows a prototype of this antenna designed using N=8 V cells on a Rogers 4003C substrate. The antenna is fed at one port while the other port is closed on a matched load. The polarization of the LWA can be changed continuously from circular to linear in the broadside direction by tuning PS1 to control the polarization of each V cell and using PS2 to compensate for the phase shift of PS1 (PS1=−PS2). Right hand circular polarization is achieved for PS1=90° and PS2=−90°. The values of axial ratios for the simulated broadside radiation patterns at the frequencies of 800 MHz, 865 MHz and 970 MHz for different values of phase shift (PS1=−PS2) are shown in FIG. 19 for different values of phase shift.

FIG. 20 illustrates the antenna radiation patterns for different frequencies of operations simulated using the Method of Moments (MoM). It will be appreciated that the beam scanning capability typical of CRLH LWAs is maintained and it is a function of the dispersion curve of the single unit cell. Broadside radiation is observed at the frequency of 865 MHz (propagation constant, β=0°), and in the left hand region (β<0°) the antenna radiates backfire and in the right hand region (β>0°) it radiates endfire. This behavior is satisfied for PS1=−PS2. In particular, in this design 2p/d=1 and therefore the radiation angle, θ, is defined as:

$$\theta = \sin^{-1}\left(\frac{\beta}{k_0}\right).$$

Another exemplary embodiment of this antenna structure is a LWA with frequency independent polarization reconfigurability. Loading the CRLH unit cell with varactor diodes, the propagation characteristics of the CRLH TL can be varied for a given frequency of operation.

The modified CRLH unit cell of FIG. 14(*a*) may be used in this configuration. As described above, two varactor diodes, $D_S$, are placed in parallel with the microstrip series interdigital capacitor IC and one varactor diode $D_{SH}$ is placed in series with the shunt inductor L. Two independent bias networks are used to separately tune the varactors $D_S$ ("S" voltage) and $D_{SH}$ ("SH" voltage). A capacitor C (C=0.5 pF) is used to decouple the two DC bias networks. The CRLH unit cell is built on Rogers 4003 substrate and the scattering parameters of Skyworks SMV1413 varactor diodes are used together with simulations based on the MoM to determine the electrical properties of the CRLH unit cell. The capacitance of the selected varactor diodes can be tuned from 10.1 pF to 1.6 pF to vary the applied voltage from 0V to 30V at the frequency of 880 MHz. The simulated dispersion diagrams of the reconfigurable CRLH are shown in FIG. 14(*b*) for different values of applied voltages "S" and "SH". It will be appreciated that the propagation constant, β, varies with the applied DC bias for the same frequency of operation.

In the embodiment of FIG. 21, N=8 V cells are cascaded to obtain a pattern and polarization reconfigurable LWA. The antenna of FIG. 21 is capable of changing the direction of radiation for a fixed frequency of operation by properly tuning the applied voltages "S" and "SH". The radiation angle, θ, is defined as $$\theta = \sin^{-1}\left(\frac{2\beta(S, SH)p}{k_0 d}\right).$$

Figure 23:
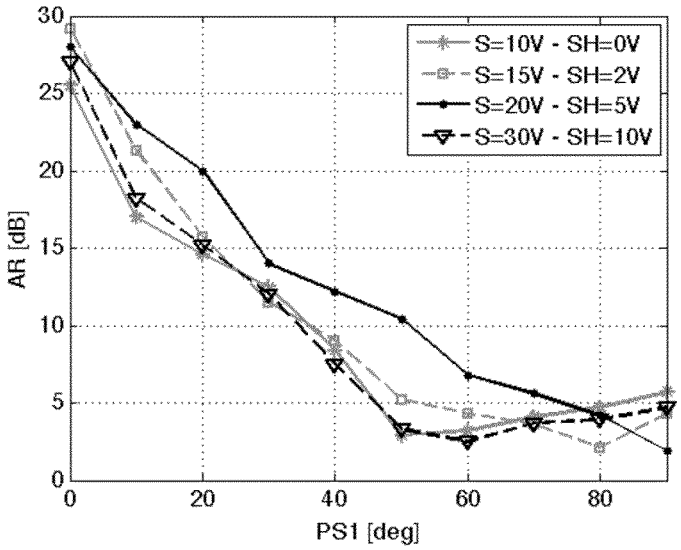
FIG. 23 illustrates axial ratio in the direction of maximum radiation for four different configurations of the pattern and polarization reconfigurable LWA in function of phase shift values (PS1=−PS2) at a frequency of 880 MHz.

FIG. 22(*a*) shows the simulated radiation patterns for a discrete set of applied voltages at the frequency of 865 MHz with 2p=d. As illustrated, configuration "SH=20V−S=5V" has the maximum gain (4.5 dBi), while configuration "SH=10V−S=0V" exhibits the minimum gain (0.5 dBi). By properly tuning the phase shifters PS1 and PS2, the polarization of the radiated field can be varied in the direction of maximum radiation. The axial ratio in the direction of maximum radiation is shown in FIG. 23 for different values of applied voltages and phase shifts.

In addition, by properly selecting the ratio 2p/d it is possible to achieve full scanning from backfire to endfire independently from the range of tunability of the variable capacitors. FIG. 22(*b*) shows the simulated radiation patterns of a LWA where 2p/d=1.2. It will be appreciated that for the same values of applied voltages the antenna scanning range is increased 27° with respect to the LWA design where 2p=d (see FIG. 22(*a*)).

In the antenna designs in accordance with the invention, the antenna's properties are reconfigured by means of variable capacitors. It is also noted that variable inductors can be used to achieve a similar behavior. It is also noted that in the described embodiments only one port is activated at a time. However, it will be appreciated that the antenna system of the invention can be used with simultaneous excitation of the two ports to achieve a symmetrical behavior with respect to the broadside direction. Another technique for efficiently using the two ports of the antenna system of the invention is to employ a switch to select the port used to feed the antenna depending on the specific wireless channel.

While the invention has been described with reference to specific embodiments, the description is illustrative of the invention and is not to be construed as limiting the invention. Various modification and applications may occur to those skilled in the art without departing from the spirit and scope of the invention as defined by the appended claims.

Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

What is claimed:

1. A pattern and/or polarization reconfigurable antenna comprising:

at least one Composite Right Left Handed (CRLH) unit cell including a standard transmission line with added series capacitance and shunt inductance and adapted to radiate an electrical field; and at least a variable capacitance and/or inductance in series with the shunt inductance and at least a variable capacitance and/or inductance in parallel with the series capacitance, whereby said at least a variable capacitance and/or inductance in series with the shunt inductance and said at least a variable capacitance and/or inductance in parallel with the series capacitance are responsive to at least two DC biases used to independently control the variable capacitance and/or inductance in parallel with the series capacitance and the variable capacitance and/or inductance in series with the shunt inductance to thereby control the group delay of the transmission line and/or a polarization of the radiated electrical field.

2. The reconfigurable antenna of claim 1, wherein the CRLH unit cell and at least a variable capacitance and/or inductance in series with the shunt inductance and at least a variable capacitance and/or inductance in parallel with the series capacitance are fabricated on a microwave laminate printed circuit board.

3. The reconfigurable antenna of claim 1 wherein multiple CRLH unit cells are cascaded to define a leaky wave structure.

4. The reconfigurable antenna of claim 3 wherein the DC biases are used to control the shape and/or direction of the radiated field, and/or the polarization of the radiated field, and/or the antenna input impedance.

5. The reconfigurable antenna of claim 4 further comprising at least two input ports for accepting excitation signals to excite the antenna.

6. The reconfigurable antenna of claim 5, wherein at least one input port is used to feed the antenna with a radio frequency signal as said excitation signal and all other input ports are closed on a matched load.

7. The reconfigurable antenna of claim 5 wherein two input ports are connected to an RF switch that alternatively allows exciting one input port of said two input ports or the other input port of the two input ports.

8. The reconfigurable antenna of claim 4, wherein the CRLH unit cells are cascaded along a straight line and the DC bias used to change the variable capacitance and/or inductance in parallel with the series capacitance is used to control the radiation angle while the DC bias used to change the variable capacitance and/or inductance in series with the shunt inductance is used to control the radiation angle, the polarization of the radiated electrical field, and impedance matching.

9. The reconfigurable antenna of claim 4, wherein the CRLH unit cells are cascaded with a zigzag shape whereby respective CRLH unit cells are substantially orthogonal to each other and the DC bias used to change the variable capacitance and/or inductance in parallel with the series capacitance is used to control the radiation angle while the DC bias used to change the variable capacitance and/or inductance in series with the shunt inductance is used to control the radiation angle, the polarization of the radiated electrical field, and impedance matching.

10. The reconfigurable antenna of claim 9, wherein the CRLH unit cells are interleaved with a variable phase shifter that dynamically controls the polarization of the radiated electrical field.

11. The reconfigurable antenna of claim 9, further comprising a capacitor that decouples respective DC bias networks that generate said at least two DC biases.

12. The reconfigurable antenna of claim 4, wherein the CRLH unit cells are cascaded along a circular arc and the DC bias used to change the variable capacitance and/or inductance in parallel with the series capacitance is used to control the polarization of the radiated field while the DC bias used to change the variable capacitance and/or inductance in series with the shunt inductance is used to control the polarization of the radiated field and impedance matching.

13. The reconfigurable antenna of claim 12, wherein pairs of said CRLH unit cells are displaced orthogonally in space along said circular arc.

14. The reconfigurable antenna of claim 12, further comprising a capacitor that decouples respective DC bias networks that generate said at least two DC biases.

15. A method of varying pattern and/or polarization of a reconfigurable antenna, comprising the steps of:

providing at least one Composite Right Left Handed (CRLH) unit cell including a standard transmission line with added series capacitance and shunt inductance and adapted to radiate an electrical field and at least a variable capacitance and/or inductance in series with the shunt inductance and at least a variable capacitance and/or inductance in parallel with the series capacitance; and separately applying at least two DC biases to said at least a variable capacitance and/or inductance in series with the shunt inductance and said at least a variable capacitance and/or inductance in parallel with the series capacitance to independently control the variable capacitance and/or inductance in parallel with the series capacitance and the variable capacitance and/or inductance in series with the shunt inductance so as to thereby control the group delay of the transmission line and/or polarization of the radiated electrical field.

16. The method of claim 15, further comprising cascading multiple CRLH unit cells so as to define a leaky wave structure.

17. The method of claim 15, further comprising applying excitation signals to at least two input ports of said leaky wave structure to excite the antenna.

18. The method of claim 17, further comprising feeding said at least one input port with a radio frequency signal as said excitation signal and closing all other input ports on a matched load.

19. The method of claim 17, further comprising alternatively exciting two input ports by selectively opening and closing an RF switch between said two input ports.

* * * * *